US005671473A

United States Patent [19]

Yamada et al.

[11] Patent Number: 5,671,473

[45] Date of Patent: Sep. 23, 1997

[54] FUSING DEVICE, A HEATING DEVICE, AND A METHOD FOR FUSING A TONER IMAGE ONTO A SHEET

[75] Inventors: Takashi Yamada; Mitsuru Isogai; Tetsuya Yamada, all of Aichi-Ken; Satoru Yoneda, Toyohashi, all of Japan

[73] Assignee: Minolta Co., Ltd., Osaka, Japan

[21] Appl. No.: 655,487

[22] Filed: May 30, 1996

[30] Foreign Application Priority Data

Jun. 12, 1995 [JP] Japan ..... 7-143790

[51] Int. Cl.[6] ..... G03G 15/20

[52] U.S. Cl. ..... 399/320; 219/216

[58] Field of Search ..... 355/282, 285, 355/290, 295; 219/216, 469–471; 432/60; 118/60; 399/320, 328, 329, 330

[56] References Cited

U.S. PATENT DOCUMENTS

| | | | |
|---|---|---|---|
| 3,948,215 | 4/1976 | Namiki | 399/328 X |
| 4,147,922 | 4/1979 | Naeser et al. | 219/216 |
| 5,027,160 | 6/1991 | Okada et al. | 399/329 |
| 5,053,829 | 10/1991 | Field et al. | 399/329 |
| 5,164,782 | 11/1992 | Nagayama et al. | 399/320 |
| 5,465,146 | 11/1995 | Higashi et al. | 399/328 |
| 5,521,688 | 5/1996 | Moser | 355/285 |

*Primary Examiner*—S. Lee

*Attorney, Agent, or Firm*—Burns, Doane, Swecker & Mathis, LLP

[57] ABSTRACT

A fusing device has a pair of fusing rollers of which at least one is covered by an elastically deformable layer of heat resistant material with the fusing rollers being brought into contact with each other; a recording material guide member and a pre-heating member having a plane-shaped heating surface opposite to the recording material guide member on an upstream side recording material which maintains a toner image away of a nip portion where the fusing roller make contact. While the recording material which maintains the toner image is guided on said recording material guide member, the toner image is heated by means of the pre-heating member and passed through the nip portion. The fusing device is set to satisfy the relationship of $0<F<0.5\theta^2+0.05\theta$ for an angle $\theta(°)$ formed by a straight line connecting the nip portion with the edge of the recording material insertion side of the pre-heating member in the vertical plane on the rotating axis of the pair of fusing rollers and a straight line connecting the nip portion with the edge of the recording material insertion side of the recording material guide member as well as for a combined force F (kg).

25 Claims, 8 Drawing Sheets

FUSING DEVICE, A HEATING DEVICE, AND A METHOD FOR FUSING A TONER IMAGE ONTO A SHEET

BACKGROUND OF THE INVENTION

1. Field of Use

The present invention relates to a fusing device that fuses a toner image onto a recording material in an image forming apparatus such as an electrophotographic copying machine or printer.

2. Description of Related Art

In an electrophotographic image forming apparatus, a toner image corresponding to an original image is formed on a recording material such as transfer paper (recording paper) and this toner image is then fused to the recording paper.

Conventionally, a heating roller type fusing device has been widely used in the fusing of the toner image to the recording material. This fusing device is comprised of a pair of rollers and a heat source inside at least one of these rollers. The pair of rollers are disposed approximately parallel to each other. Further, these rollers make contact with each other at a fixed pressure forming a fixed nip at that contact area. At least one of these rollers is driven to rotate by means of a drive source and the recording material fed into the nip portion is further fed following this rotation. Pressure and heat are then applied from both rollers to the recording material at the nip portion to fuse the toner image onto the recording material.

In contrast to this, a fusing device in which, in addition to a pair of rollers alternately making contact with each other, a third roller is provided as well as a fusing belt wrapped around and stretched between one side of said pair of rollers and the third roller, has recently been proposed. See, for example, Japanese Laid-open patent Hei 6-318001. FIG. 7 shows the construction of this fusing device. This fusing device has a fusing roller 81 and a heating roller 82 arranged parallel to each other. The heating roller 82 has an internal heat source. Further, an endless belt 83 is wrapped around and stretched between these rollers 81, 82. A heating roller 84 is further provided below the fusing roller 81. The heating roller 84 makes contact with the fusing roller 81 by means of the belt 83. At the position where the rollers 81, 84 make contact, a nip portion 80 is formed having a fixed width. Moreover, a prefusing guide 85 is provided on the upstream side of the nip portion 80 in the feed direction (left direction in the figure) of the recording material S1.

In this fusing device, the fusing roller 81 is driven to rotate which in turn drives the belt 83 in the same direction along with the heating roller 82. The pressure roller 84 is also driven to rotate. Further, each portion of the belt 83 is heated by the heating roller 82 before they reach the nip portion 80. The heated portions preheat and soften the toner image T1 on the recording material S1 that is guided on the prefusing guide 85 and is fed. Then, toner image fusing is carried out by passing the recording material S1 into the nip portion 80.

This fusing belt type fusing device can set the fusing temperature to a low temperature by means of dispersing the time and location at which the toner on the recording material is heated by the belt heat in a fixed area. This provides advantages including a shorter time required to increase the temperature for the fusing in the fusing device as well as energy conservation.

Furthermore, in place of this type of fusing belt, arranging a stationary heat-generating member such as a flat heat-generating member as the preheating member has been proposed. See, for example, Japanese Laid-open patent Sho 59-211073. FIG. 8 shows the construction of this fusing device. This fusing device has a pair of fusing rollers 91, 92. These fusing rollers 91, 92 make contact with each other to form a nip portion 90. Moreover, the fusing roller 91 has an internal heat source 93.

Further, a recording material guide plate 94 is provided on the upstream side of the nip portion 90 in the feed direction (right direction in the figure) of the recording paper S1. A plate-shaped heating member 95 is further provided above the recording material guide plate 94. The recording material S1 is guided between the recording material guide plate 94 and the plate-shaped heating member 95 extending to the nip portion 90. The toner image T1 on the recording material S1 is softened by placing the recording material S1 opposite to the plate-shaped heating member 95 and then it is fused onto recording material S1 by passing the recording material S1 through the nip portion 90.

However, in a heating roller type fusing device that uses a roller pair as initially described, the heating required to melt and fuse the toner is only applied at the nip portion between the roller pair. Therefore, it is necessary to heat and pressurize the nip portion intensively, and as a result, wrinkles and other problems occur on the recording material while passing through the nip portion, especially in the case where, for example, the recording material has a construction in which it is folded over to form an envelope-like shape.

In this respect, in the fusing device of FIG. 7 and the fusing device of FIG. 8, the temperature and pressure force of the nip portion can be set low because the recording material is preheated before it reaches the nip portion. Therefore, the chances of wrinkles and other problems occurring on the recording material at the nip portion are reduced. However, even if the pressure force is set at a level where there is no chance of wrinkles and other problems occurring on the recording material, there are problems of the trailing edge of the recording material moving at the moment the recording material penetrates into the nip portion, and the toner image portion that is not yet fused will rub or make contact with the fusing belt or flat heating member resulting in an image distortion.

Therefore, in order to solve these problems it is necessary to set the nip portion pressure at a substantially low level. In order to ensure proper fusing of the toner image at a low pressure, it is necessary to compensate for the insufficient fusing energy at the nip portion using a preheated portion. Further, in order to increase the heating effect of a preheating member, it is necessary to narrow the gap between the prefusing guide and the preheating member. However, if this gap is made too narrow, there is a chance that the toner image on the recording material may make contact with the preheating member again. In this way it is exceedingly difficult to set the gap between the prefusing guide and the preheating member and the pressure force of the nip portion in order to sufficiently suppress the occurrence of image noise and wrinkles on the recording material to favorably fuse the toner image.

SUMMARY AND OBJECTS

This invention proposes to favorably fuse a toner image while sufficiently suppressing the occurrence of image noise and the occurrence of wrinkles in the recording material for a recording material selected and used from among a wide range of materials by setting a relationship between the toner image fusing pressure in the nip portion between the pair of fusing rollers and the arrangement of the preheating member and the recording material guide member at the upstream side of the nip portion. The invention is particularly applicable to a fusing device having a pair of fusing rollers of which at least one is covered by an elastically deformable layer of heat resistant material and the fusing rollers are brought into contact with each other. The fusing device may be further provided with a recording material guide member and a preheating member having a plane-shaped heating surface opposite the recording material guide member on the upstream side of the nip portion where the fusing rollers make contact.

The inventors found the relationships set forth below reduce the occurrence of wrinkles in the recording material while passing through the nip portion, reduce the occurrence of image noise caused by the toner image on the recording material rubbing and making contact with the preheating member, and allow the recording material to stably pass through the nip portion and the toner image to be sufficiently preheated, to then favorably carry out toner image fusing. The relationships are particularly appropriate in a type of fusing device provided with a pair of fusing rollers of which at least one is covered by an elastically deformable layer of heat resistant material, which are brought into contact with each other, which device has a recording material guide member and a preheating member having a plane-shaped heating surface opposite the recording material guide member provided on an upstream side of the nip portion where the fusing rollers make contact.

The gap between the preheating member and the recording material guide member is represented by an angle θ (°) formed by a straight line connecting the nip portion with the edge of the recording material insertion side of the preheating member in a vertical plane on the rotating axis of the pair of fusing rollers and a straight line connecting the nip portion with the edge of the recording material insertion side of the recording material guide member. The combined force at the nip portion N between the fusing rollers is represented by F (kg).

When the recording material passes through the nip portion of the pair of fusing rollers, the trailing edge of the recording material has a tendency to jump away from the recording material guide member due to factors such as the difference in the peripheral speed of both rollers and the degree that one roller bites into the other roller. However, that degree of jumping is dependent on the combined force F (kg) of the nip portion and the angle θ (°).

The present invention provides a fusing device that is preferably set to satisfy the relationship of $0<F<0.5\theta^2+0.05\theta$. The relationship is particularly relevant to a fusing device having a pair of fusing rollers of which at least one is covered by an elastically deformable layer of heat resistant material with the fusing rollers being brought into contact with each other. As a result, the conditions under which the toner image will rub and make contact with the preheating member resulting in the occurrence of image noise due to the jumping of the trailing edge of the recording material can thus be sufficiently suppressed allowing the recording material to stably pass along with allowing the preheating to be used to its maximum limits to achieve stable fusing characteristics at comparatively low fusing temperatures. This then allows the toner image to be favorably fused.

In such a fusing device, the preheating member can be made from a material that allows preheating up to a degree at which there is no hindrance to fuse the toner image on the recording material at the nip portion. As one example, a heatable endless fusing belt can be used that is wrapped around and stretched between one of the pair of fusing rollers and a heating roller that is a third roller. When this fusing belt is utilized, the pair of fusing rollers are brought into contact with each other by means of said belt. Each portion of the fusing bolt is heated by a heating roller before each portion reaches the nip portion.

Further, as another example of the preheating member, a member in which a flat-shaped heat-generating body (synthetic resin sheet-shaped body which generates heat by a heater, metal oxide sheet-shaped body which generates heat by a heater, or a panel heater with an internal heating medium) is provided can be used.

As necessary, at least one of the pair of fusing rollers (for example, a roller on the side opposite the toner image on the recording material) can be provided with an internal heater.

DETAILED DESCRIPTION OF THE PREFERRED EMBODIMENTS

Figure 1:
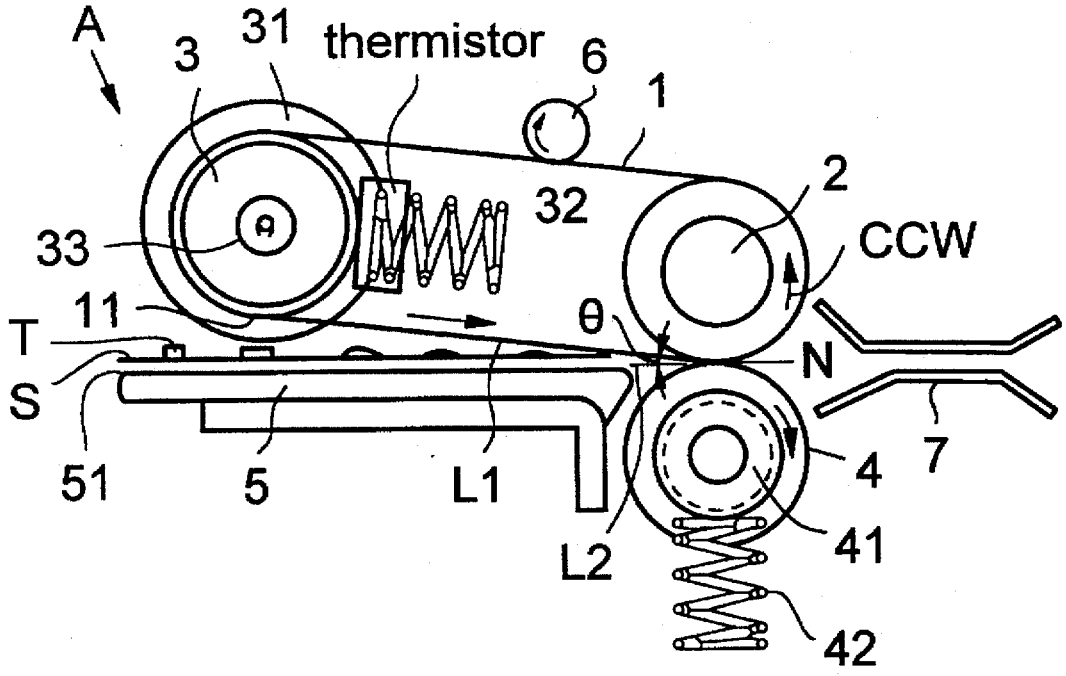
FIG. 1 is a side-view showing of a fusing device of a first embodiment of the present invention.

Referring now to the drawings, preferred embodiments of the present invention will be described.

FIG. 1 is a side-view showing an outline of a fusing device A according to a first embodiment of the present invention. FIGS. 3, 5, 9, and 10 are side-views showing additional embodiments of the present invention. Any of these fusing devices can be incorporated and used in an electrophotographic image forming apparatus.

The fusing device A of FIG. 1 is comprised of a fusing belt 1, a pair of fusing rollers 2, 4, parallel to each other, a heating roller 3, and a freely rotating roller 6 that makes contact with and applies offset suppression oil to a prefusing guide 5 and the belt 1. The roller 6 can be attached and removed for replacement.

The fusing belt 1 is used as a preheating member together with the heating roller 3 and is wrapped around and stretched between one of the fusing rollers 2 and the heating roller 3.

The fusing roller 2 is at a fixed position where it is supported by a pair of bearings (not shown in the figure) and is driven to rotate in the CCW direction of the arrow in the figure by a drive means (not shown in the figure).

The heating roller 3 is rotatably supported by a pair of heating roller bearings 31 (only one is shown in the figure).

These bearings 31 are supported by a bearing support member (not shown in the figure) so they can move towards and away from the fusing roller 2. Further, a spring 32 applies a fixed force to keep the bearings 31 in a direction away from the fusing roller 2. By means of the force from the spring 32, the heating roller applies tension to the fusing belt 1. The heating roller 3 is provided with an internal heater 33.

A thermistor TH is arranged at an exposed portion of the roller 3 where the belt 1 of the heating roller 3 is not wrapped. This thermistor TH is connected to a temperature controller (not shown in the figure). The temperature controller controls the heater 33 based on signals from the thermistor, specifically, the signals indicating the surface temperature of the heating roller 3. By carrying out control of the heater 33, the temperature of the fusing belt 1 and the nip portion N is maintained uniformly.

The other fusing roller 4 functions as a pressure roller and is referred to hereinafter as a "pressure roller" or "roller". The pressure roller 4 is rotatably supported by a pair of pressure roller bearings 41 (only one is shown in the figure). Each bearing 41 is supported by a bearing support member (not shown in the figure) so they can move towards and away from the fusing roller 2. Further, a spring 42 applies a fixed force to keep the bearings 41 in a direction toward the fusing roller 2. By means of the force from the spring 42, the pressure roller 4 is brought into contact with the fusing roller 2 by means of the belt 1 to form a nip portion N between the rollers 2, 4.

The prefusing guide 5 is a plate-shaped guide used as a recording material guide member. The prefusing guide 5 is adjacent to the nip portion N between the rollers 2, 4. Specifically, the prefusing guide 5 is adjacent the nip portion N at the side upstream of the nip portion N between the fusing belt 1 and the pressure roller 4 and where these make contact with each other in the feed direction of the recording material. A paper delivery guide 7 is provided on the downstream side of the nip portion N.

In the fusing device A of this embodiment, an angle θ formed by the straight line L1 connecting the nip portion N with the edge 11 of the recording material insertion side of the fusing belt 1 and the straight line L2 connecting the nip portion N with the edge 51 of the recording material insertion side of the prefusing guide 5 at one arbitrary vertical plane on the rotating axis of the fusing roller 2 and the combined force F (kg) of the nip portion N are set to satisfy the relationship of $0<F<0.5\theta^2+0.05\theta$, wherein F is the nip portion combined force in kg.

In other words, an appropriate nip portion combined force F and an angle are selected and set to sufficiently suppress the occurrence of wrinkles on the recording material S and the occurrence of image noise within a range that satisfies the relationship of $0<F<0.5\theta^2+0.05\theta$ for the combined force F (kg) of the nip portion and the angle θ in correspondence to the heating ability by means of the fusing belt 1 of the toner image T on the recording material and the construction of the pair of rollers 2, 4.

Next, the material of each portion will be described.

The fusing belt 1 is an endless belt made of nickel and manufactured by the electroforming method with an external diameter of 50 mm and a thickness of 40 μm. The surface of the fusing belt is covered by a heat resistant separation layer which is, for example, a silicon rubber layer.

Moreover, the fusing belt is not restricted to this type of belt. Normally, any belt comprised by a heat conductive body having a suitable strength can be considered. For example, belts such as carbon steel, stainless steel alloy or nickel whose surface is preferably covered by either a heat resistant separation layer such as a silicon rubber layer or a heat resistant rubber layer having separation properties may be used.

Both the fusing roller 2 and the pressure roller 4 have an external diameter of 20 mm and are formed with an elastically deformable silicon rubber layer having heat resistant properties evenly coated on the outer peripheral surface of a metallic core bar made of aluminum.

Moreover, the construction of the rollers 2, 4 is not restricted to this type of construction. For example, in regard to the pressure roller 4 may be any type of metallic tube roller, metallic pipe roller, or silicon rubber roller.

The heating roller 3 is formed by aluminum pipe having a thickness of 0.9 mm and an external diameter of 20 mm. The heating roller is provided with a 600 W halogen heater as an internal heater 33. The surface temperature of the heating roller 3 can be 165° C. or more and the fusing temperature in the nip portion N is normally set to 165° C.

The prefusing guide 5 is a flat metallic plate which has a flat recording material guide surface.

The operation of the fusing device A described above will be described. The fusing belt 1 travels by means of rotation of the fusing roller 2. The heating roller 3 and the pressure roller 4 are driven to rotate by the travel of the fusing belt 1. The spring 42 presses on the bearing 41 of the pressure roller 4 towards the fusing roller 2 creating the nip portion N between the pressure roller 4 and the fusing belt 1.

After silicon oil to suppress offset is applied by means of an oil application roller 6, while the traveling fusing belt 1 is preheated by the heating roller 3, the belt 1 travels on the upper portion of the prefusing guide 5 and proceeds to the nip portion N between the fusing belt 1 and the pressure roller 4.

Conversely, the recording material S which maintains the toner image T is fed to a feeding device (not shown in the figure) and is then guided on the prefusing guide 5 and sent to the nip portion N. At this time, the toner image T is heated (radiant heat) by the heat of the belt 1 portion opposite the image to a degree where it is appropriately softened. The recording material S is then inserted into the nip portion N. In the nip portion N, the toner image T is heated and pressurized and then fused onto the recording paper S.

The offset, i.e., transfer, of toner to the fusing belt 1 in the nip portion is prevented because silicon oil is previously applied to the fusing belt 1. The recording material S after toner image fusing is guided by the paper delivery guide 7 and then delivered.

Furthermore, almost all the heat accumulated in the fusing belt 1 is transferred to the recording paper S at the nip portion N. This functions to lengthen the portion of the fusing device A raised to a high temperature from the position of the heating roller 3 to the nip portion N. In other words, it is sufficient if the fusing belt 1 is heated only at one portion on the side further upstream than the nip portion N. Therefore, the power required in the heater 33 is conserved. The following points are considered important in this type of fusing device A in the present invention.

When the recording material S passes through the nip portion N of the pair of rollers 2, 4, the trailing edge of the recording paper S jumps away from the prefusing guide 5 due mainly to the difference in the peripheral speed of both rollers. However, the degree the recording paper jumps is dependent on the combined force F (kg) of the nip portion N. Conversely, the angle θ formed by the straight line L1 connecting the nip portion N with the edge 11 of the recording material insertion side of the fusing belt 1 and the straight line L2 connecting the nip portion N with the edge 51 of the recording material insertion side of the prefusing guide 5 is regulated to satisfy the relationship of $0<F<0.5\theta^2+0.05\theta$. Therefore, the state in which the toner image T rubs and makes contact with the fusing belt 1 due to the jumping of the trailing edge of the recording material S resulting in the occurrence of image noise is sufficiently suppressed thus making it possible to ensure stable paper passing properties. In addition, the preheating by means of the fusing belt 1 can be used to its maximum limits to achieve stable fusing characteristics at comparatively low fusing temperatures.

Next, experiments which show the state in which the condition of $0<F<0.5\theta^2+0.05\theta$ is preferred will be described. Further, in the following description, the above-mentioned angle θ is referred as the paper passage insertion angle.

In the initial experiment, we examined the occurrence conditions of the toner image rubbing against the fusing belt 1 were examined by changing the paper passage insertion angle θ to many different values with the fusing temperature at the nip portion N set to 165° C. along with changing the nip portion combined force F (kg) to many different values for each angle. The recording material which maintains the toner image is in an envelope-like shape.

Table 1 shows the results. In Table 1, "X" character indicates the combination of and F could not be used because image (toner image) rubbing occurred.

TABLE 1

| | | Nip portion combined force F (kg) | | | | |
|---|---|---|---|---|---|---|
| | | 5 | 10 | 15 | 20 | 40 |
| Paper passage insertion angle θ (°) | 2 | X | X | X | X | X |
| | 3.5 | ○ | X | X | X | X |
| | 5 | ○ | ○ | X | X | X |
| | 6 | ○ | ○ | ○ | X | X |
| | 7 | ○ | ○ | ○ | ○ | X |
| | 12 | ○ | ○ | ○ | ○ | 603 |

From the results of Table 1, Table 2 was formulated to show the relationship between the paper passage insertion angle and the combined force of the pressure nip portion that ensures a stable passage of paper as well as ensuring the preheating effect to its maximum limits.

TABLE 2

| Paper passage insertion angle θ (°) | 3.5 | 5 | 6 | 7 | 12 |
|---|---|---|---|---|---|
| Nip portion combined force F (kg) | 5 | 10 | 15 | 20 | 40 |

Identical experiments were further carried out with fusing temperatures at the nip portion of 145° C., 155° C. and 175° C. Table 3 shows the relationship between the paper passage insertion angle and the combined force of the pressure nip portion that ensures a stable passage of paper as well as ensuring the preheating effect to its maximum limits. Further, Table 3 shows the results shown in Table 2 also.

TABLE 3

| Fusing temperature (°C.) | | Paper passage insertion angle θ (°) | | | | |
|---|---|---|---|---|---|---|
| | | 3.5 | 5 | 6 | 7 | 12 |
| 145 | Nip portion | 5 | 10 | 15 | 20 | 40 |
| 155 | combined | 5 | 10 | 15 | 20 | 40 |
| 165 | force F | 5 | 10 | 15 | 20 | 40 |
| 175 | (kg) | — | 5 | 10 | 15 | 20 |

Figure 2:
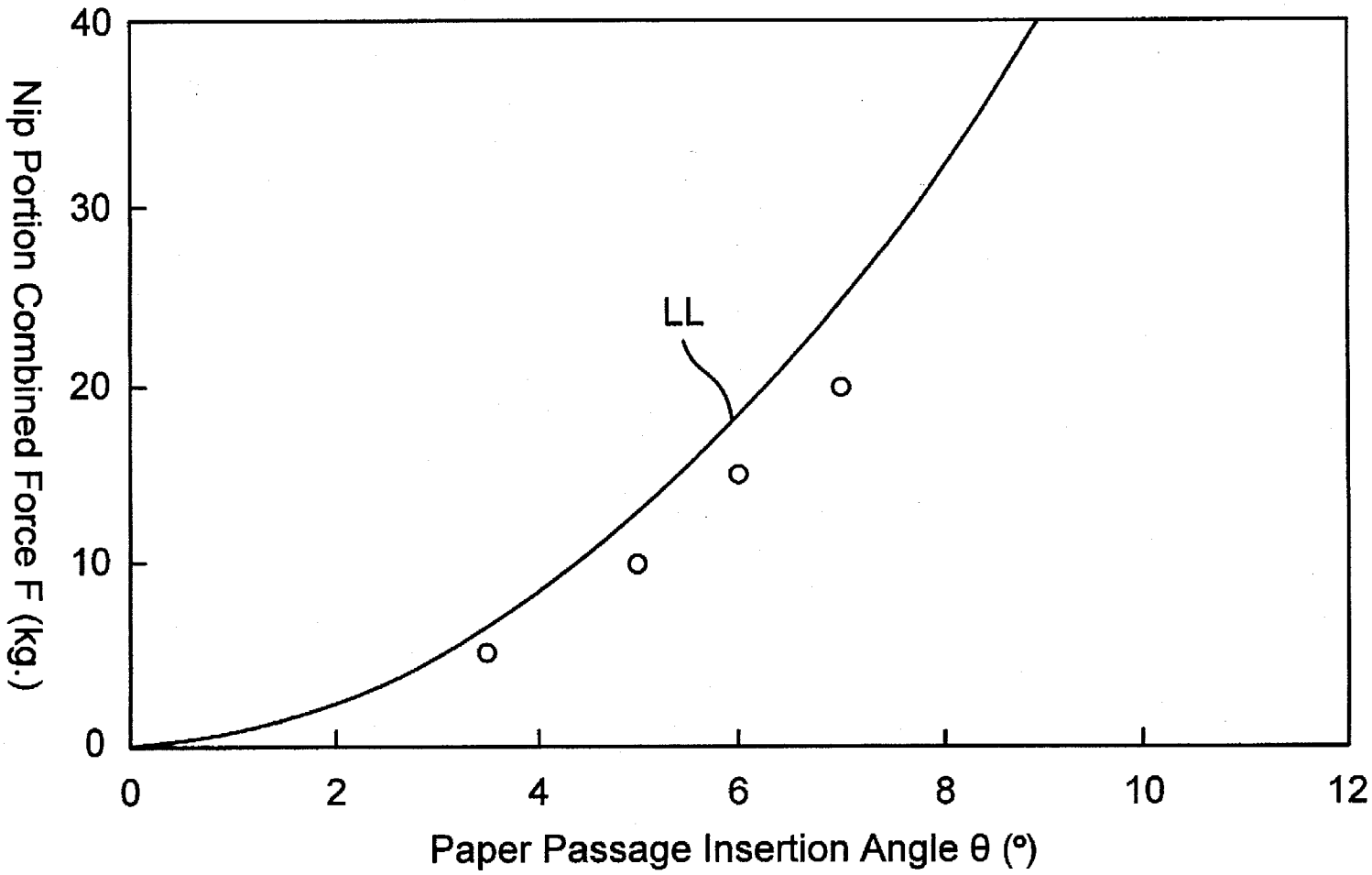
FIG. 2 is a graph showing experimental results of the fusing device shown in FIG. 1.

The ordinate (nip portion combined force F) and the abscissa (paper passage insertion angle θ) coordinates of FIG. 2 show the results of Table 2 and Table 3. Boundary line LL drawn in FIG. 2 safely regulates the preferable relationship between F and θ. From this point, it was confirmed the relation of $F<0.5\theta^2+0.05\theta$ held in the range from 145° C. to 175° C. and there was not difference in the occurrence of image rubbing from 145° C. to 165° C. Accordingly, it is assumed that the above-mentioned relationship holds at 145° C. or less. The reason the combined force F of nip portion N allowable at 175° C. decreases to a value less than the case when the temperature is less than 175° C. is that the moisture content of the upper and lower sides of the paper folded over to form an envelope shape varies greatly which in turn makes the curl larger thereby making it easier for the image to rub against the belt 1 due to jumping of the trailing edge of the envelope-shaped material.

Figure 3:
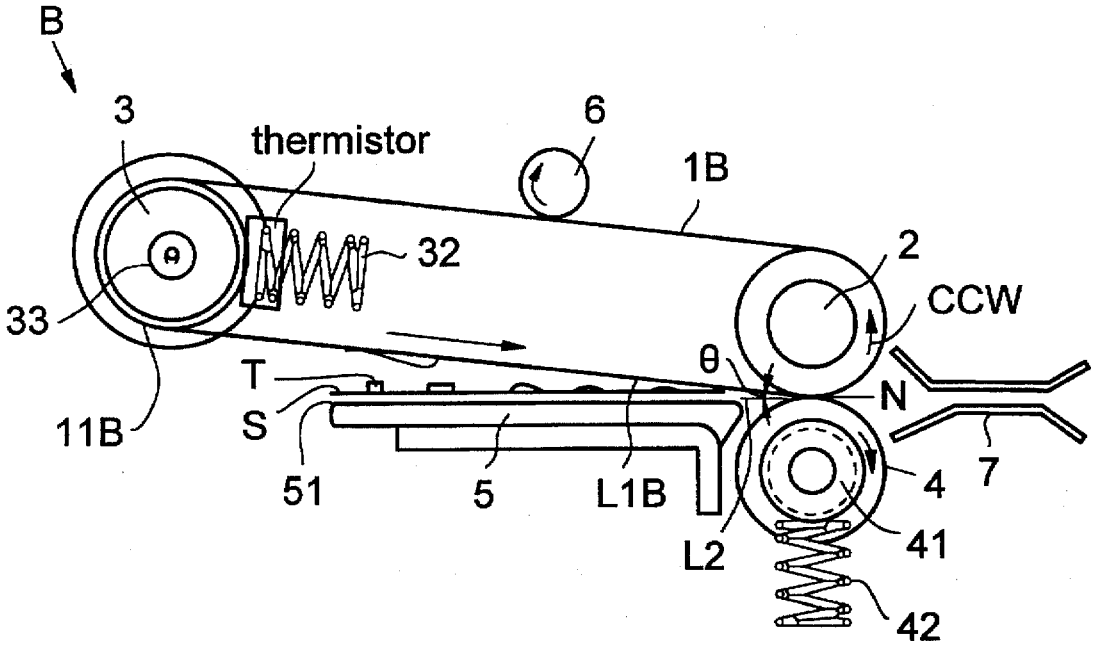
FIG. 3 is a side-view showing of a fusing device of another embodiment of the present invention.

Next, the fusing device B shown in FIG. 3 will be described.

In place of the fusing belt 1 in the fusing device A shown in FIG. 1, the fusing device B uses a fusing belt 1B made of the same material as the belt 1 but with a longer length (external diameter 80 mm) and has basically the same construction as the device A excluding the extended preheating distance of the toner image. Identical symbols and numbers are used for parts identical to device A.

In this fusing device B, the angle θ is formed by the straight line L1B connecting the nip portion N with the edge 11B of the recording material insertion side of the fusing belt 1B at one arbitrary vertical plane on the rotating axis of the fusing roller 2 and the straight line L2 connecting the nip portion N with the edge 51 of the recording material insertion side of the prefusing guide 5. The combined force F (kg) of the nip portion and the angle (θ)° are set to satisfy the relationship of $0<F<0.5\theta^2+0.05\theta$.

By using this fusing device B, the state in which the toner image T rubs and makes contact with the belt 1B due to the jumping of the trailing edge of the recording paper resulting in the occurrence of image noise can be sufficiently suppressed allowing the recording paper to stably pass along while allowing the preheating by means of belt 1B to be used to its maximum limits to achieve stable fusing characteristics at comparatively low fusing temperatures. These then allow the toner image to be favorably fused.

Furthermore, in the fusing device B, we also examined the occurrence conditions of the toner image rubbing against the fusing belt 1B by changing the paper passage insertion angle θ to many different values with the fusing temperature at the nip portion N set to 165° C. along with changing the nip portion combined force F (kg) to many different values for each angle. The recording material which maintains the toner image is in an envelope shape identical to that of the case for device A. Table 4 shows the results. In Table 4, "X"

indicates the combination of and F could not be used because image (toner image) rubbing occurred.

TABLE 4

| | | Nip portion combined force F (kg) | | | | |
|---|---|---|---|---|---|---|
| | | 5 | 10 | 15 | 20 | 40 |
| Paper passage insertion angle θ (°) | 3.6 | ○ | X | X | X | X |
| | 4.9 | ○ | ○ | X | X | X |
| | 6 | ○ | ○ | ○ | X | X |
| | 7.3 | ○ | ○ | ○ | ○ | X |
| | 10 | ○ | ○ | ○ | ○ | 603 |

From the results of Table 4, Table 5 was formulated to show the relationship between the paper passage insertion angle and the combined force of the pressure nip portion that ensures a stable passage of paper as well as ensuring the preheating effect to its maximum limits.

TABLE 5

| | | | | | |
|---|---|---|---|---|---|
| Paper passage insertion angle θ (°) | 3.6 | 4.9 | 6 | 7.3 | 10 |
| Nip portion combined force F (kg) | 5 | 10 | 15 | 20 | 30 |

Figure 4:
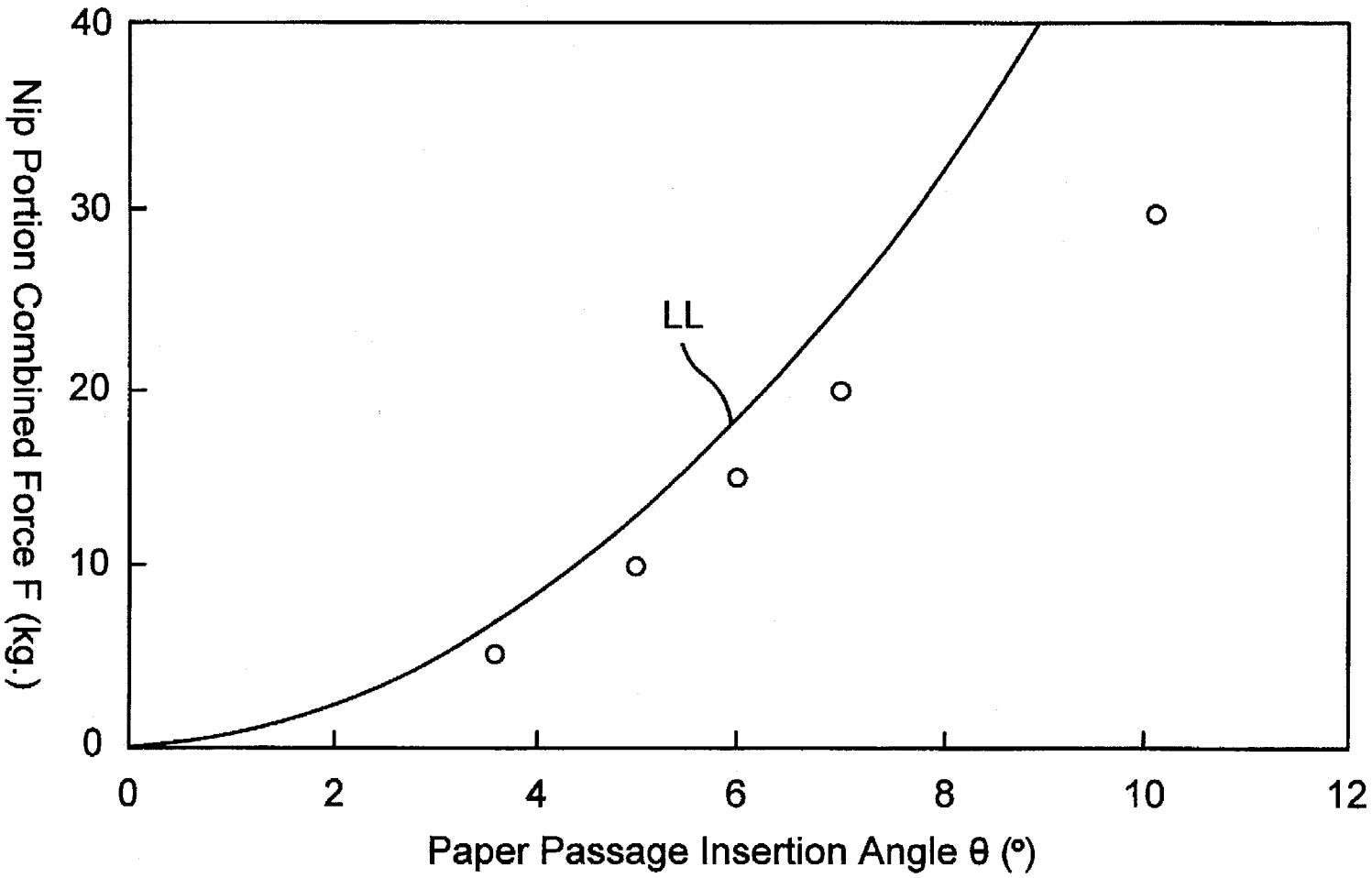
FIG. 4 is a graph showing experimental results of the fusing device shown in FIG. 3.

The ordinate (nip portion combined force F) and the abscissa (paper passage insertion angle θ) coordinates show the results of Table 5 and boundary line LL drawn in FIG. 4 safely regulates the preferable relationship between F and θ. From this point it was confirmed the relation of $F<0.5\theta^2+0.05\theta$ held even if the preheating distance was extended.

Figure 5:
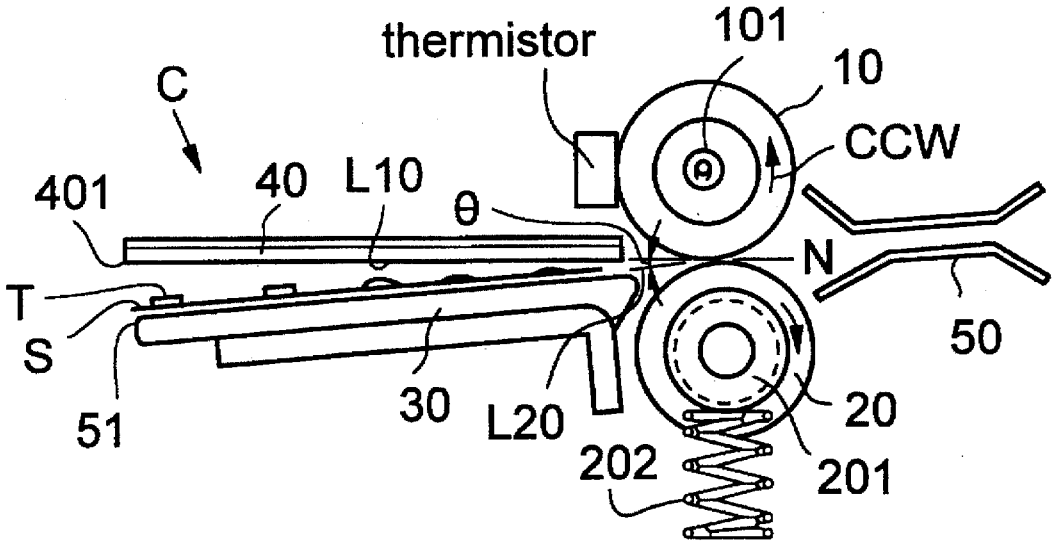
FIG. 5 is a side-view showing a fusing device of another embodiment of the present invention.

Next, the fusing device C shown in FIG. 5 will be described.

The fusing device C is comprised of a pair of fusing rollers 10, 20 arranged parallel to each other, a prefusing guide 30, and a flat heat-generating body 40 above the prefusing guide.

One of the rollers, the fusing roller 10 is supported by a bearing (not shown in the figure) at a fixed position and is driven to rotate in the CCW direction in the figure by a drive means (not shown in the figure). Further, the roller 10 has an internal heater 101.

The other one of the rollers, the fusing roller 20 functions as a pressure roller and is referred to hereinafter as a "pressure roller" or simply as a "roller". The pressure roller 20 is rotatably supported by a pair of pressure roller bearings 201 (only one is shown in the figure). Each bearing 201 is supported by a bearing support member (not shown in the figure) so it can move towards and away from the fusing roller 10. Further, a spring 202 applies a fixed force urging the bearings 201 in a direction toward the fusing roller 10. By means of the force from the spring, the pressure roller 20 is brought into contact with the fusing roller 10 to form a nip portion N.

The prefusing guide 30 is a plate-shaped guide used as a recording material guide member. The prefusing guide 30 is adjacent to the nip portion N at a side upstream of the nip portion N in the feed direction of the recording material. A paper delivery guide 50 is provided on the downstream side of the nip portion N. A flat heating body 40 is used as a preheating member. The flat heat-generating body 40 is arranged to allow the toner image T on the recording material S guided on the prefusing guide 30 to be heated along the width of the recording material in a fixed area.

Furthermore, a thermistor TH is arranged on the surface of the fusing roller 10. The thermistor TH is connected to a temperature controller (not shown in the figure). The temperature controller controls a heater 101 disposed inside the fusing roller 10 based on signals from the thermistor TH indicating the surface temperature of the fusing roller 10. Therefore, the temperature of the fusing roller 10 is maintained at a fixed temperature.

The angle θ formed by the straight line L10 connecting the nip portion N with the edge 401 of the recording material insertion side of the flat heat-generating body 40 at one arbitrary vertical plane on the rotating axis of the fusing roller 10 and the straight line L20 connecting the nip portion N with the edge 301 of the recording material insertion side of the prefusing guide 30 and the combined force F (kg) of the nip portion N are set to satisfy the relationship of $0<F<0.5\theta^2+0.05\theta$.

In other words, an appropriate nip portion combined force F and an angle θ are selected and set to sufficiently suppress the occurrence of wrinkles on the recording material S and the occurrence of image noise within a range that satisfies the relationship of $0<F<0.5\theta^2+0.05\theta$ for the combined force F (kg) of the nip portion and the angle θ in correspondence to the heating ability of the toner image T on the recording material by the heating body 40 and the construction of the pair of rollers 10, 20.

Next, the material of each portion will be described.

The fusing roller 10 is formed from aluminum pipe having a thickness of 0.9 mm and an external diameter of 20 mm. The roller 10 is evenly coated on the outer peripheral surface of the pipe with a silicon rubber layer having heat resistant properties and is elastically deformable. The internal heater 101 provided inside the fusing roller 10 is preferably a 200 W halogen heater. The surface temperature of the roller 10 is normally set to 145° C.

The flat heater 40 is formed by a 400 W ceramic heater with a length of 40 mm and a thickness of 2.5 mm. The surface temperature of the heating surface is normally set to 165° C.

The pressure roller 20 has an external diameter of 20 mm and is evenly coated on the outer peripheral surface of an aluminum metallic core with a silicon rubber layer in like manner to the roller 10.

The prefusing guide 30 is a flat metallic plate which has a flat recording material guide surface.

According to the fusing device C described above, the fusing roller 10 is driven to rotate. The pressure roller 20 is driven to rotate by the rotation of the fusing roller 10.

The recording material S (recording paper) which maintains the toner image T is fed to a feeding device (not shown in the figure) and is then guided on the prefusing guide 30 and sent to the nip portion N. At this time, the toner image T is heated (radiant heat) by the heating body 40 opposite to this image to a degree where it is appropriately softened. The recording material S is then inserted into the nip portion N. In the nip portion N, the toner image T is heated and pressurized and then fused onto the recording paper S. The recording material S after toner image fusing is guided by the paper delivery guide 50 and then delivered.

In the fusing device C, when the recording paper S passes through the nip portion N of the pair of rollers 10, 20, the trailing edge of the recording paper S jumps away from the prefusing guide 30 due mainly to the difference in the peripheral speed of both rollers. However, the degree the recording material jumps is dependent on the combined force F (kg) of the nip portion N. Conversely, the angle θ formed by the straight line L10 connecting the nip portion N with the edge 401 of the recording material insertion side of the flat heating body 40 and the straight line L20 connecting the nip portion N with the edge 301 of the recording material insertion side of the prefusing guide 30 is regulated to satisfy the relationship of $0<F<0.5\theta^2+0.05\theta$. Therefore, the state in which the toner image T rubs and makes contact with the heat-generating body 40 due to the jumping of the trailing edge of the recording paper S resulting in the occurrence of image noise is sufficiently suppressed thus making it possible to ensure stable paper passing properties. In addition, the preheating by means of the heating body 40 can be used to its maximum limits to achieve stable fusing characteristics at comparatively low fusing temperatures. These reasons allow the toner image to be favorably fused.

Furthermore, in the fusing device C, the occurrence conditions of the toner image rubbing against the flat heat-generating body 40 were examined by changing the paper passage insertion angle θ to many different values with the fusing temperature at the nip portion N set to 145° C. along with changing the nip portion combined force F (kg) to many different values for each angle. The recording material which maintains the toner image is in an envelope shape identical to that of the case for the experiments of device A.

Table 6 shows the results. In Table 6, "X" indicates the combination of θ and F that could not be used because image (toner image) rubbing occurred.

TABLE 6

| | | Nip portion combined force F (kg) | | | | |
|---|---|---|---|---|---|---|
| | | 10 | 14 | 18 | 22 | 26 |
| Paper passage insertion angle θ (°) | 4 | X | X | X | X | X |
| | 5.2 | ○ | X | X | X | X |
| | 6.3 | ○ | ○ | X | X | X |
| | 7.2 | ○ | ○ | ○ | X | X |
| | 8.1 | ○ | ○ | ○ | ○ | X |
| | 9.3 | ○ | ○ | ○ | ○ | 603 |

From the results of Table 6, Table 7 was formulated to show the relationship between the paper passage insertion angle and the combined force of the pressure nip portion that ensures a stable passage of paper as well as ensuring the preheating effect to its maximum limits.

TABLE 7

| Paper passage insertion angle θ (°) | 5.2 | 6.3 | 7.2 | 8.1 | 9.3 |
|---|---|---|---|---|---|
| Nip portion combined force F (kg) | 10 | 14 | 18 | 22 | 26 |

Figure 6:
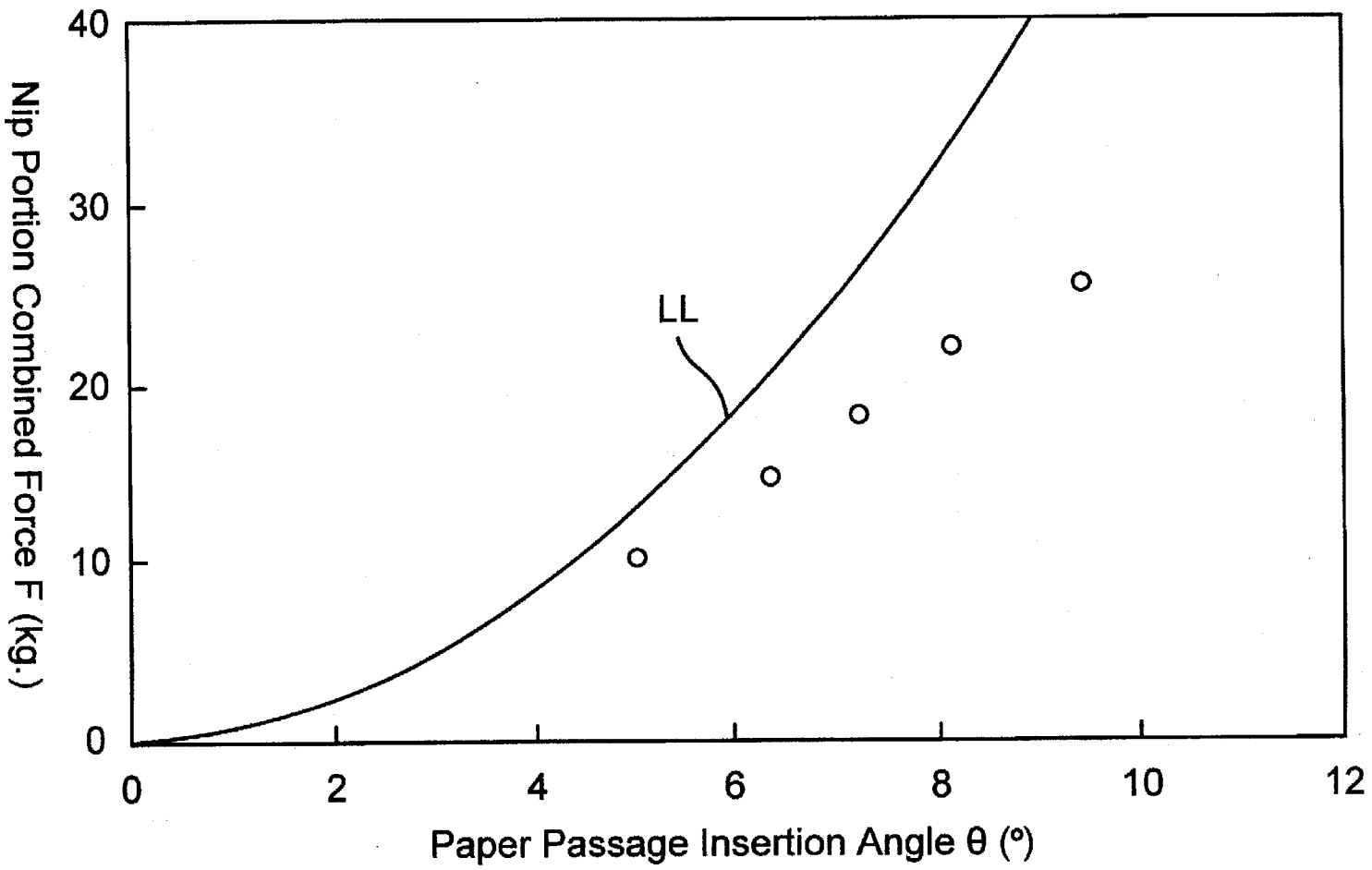
FIG. 6 is a graph showing experimental results of the fusing device shown in FIG. 5.
Figure 7:
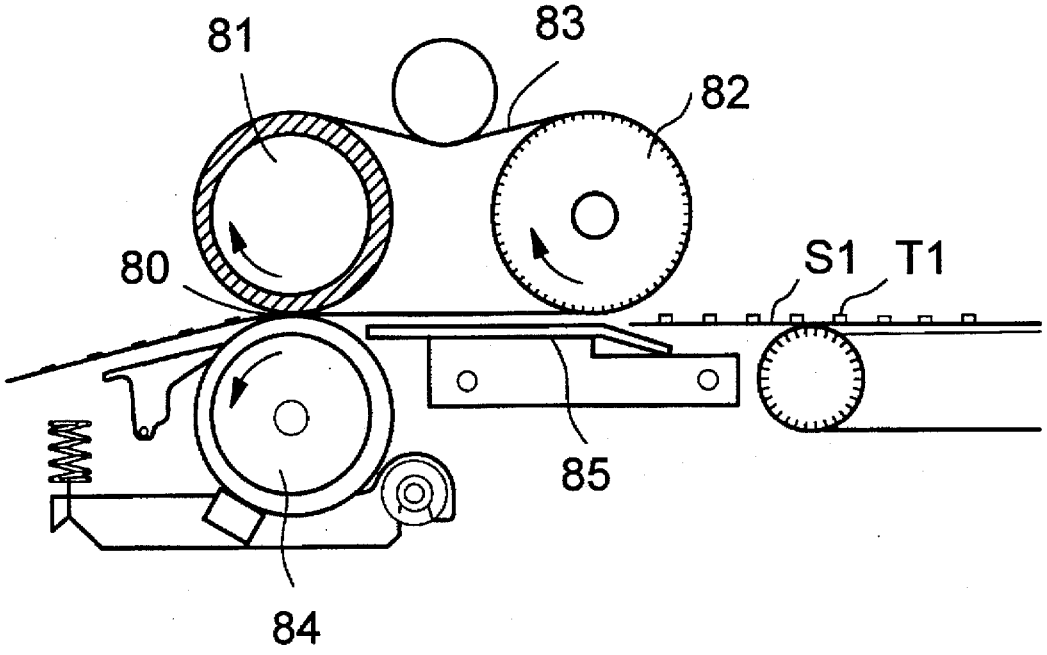
FIG. 7 PRIOR ART
FIG. 7 is a side-view showing another conventional fusing device.
Figure 8:
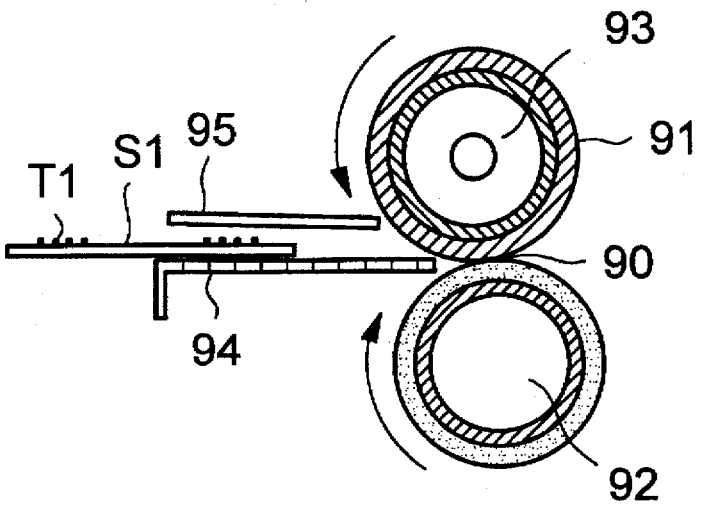
FIG. 8 PRIOR ART
FIG. 8 is a side-view showing another conventional fusing device.

The ordinate (nip portion combined force F) and the abscissa (paper passage insertion angle θ) coordinates of FIG. 6 show the results of Table 7. Boundary line LL drawn in FIG. 6 safely regulates the preferable relationship between F and θ. From this point, it was confirmed that even for device C, the relation of $F<0.5\theta^2+0.05\theta$ held.

Figure 9:
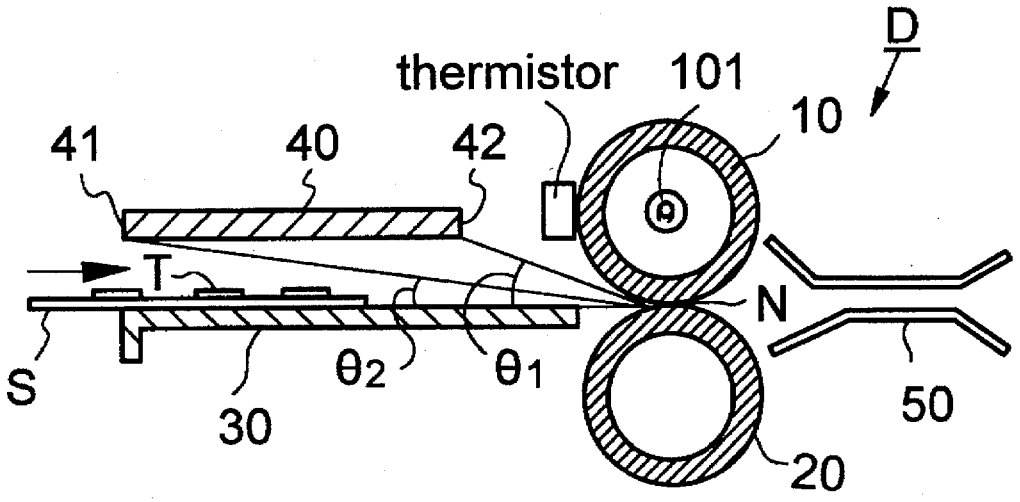
FIG. 9 is a side-view showing a fusing device of another embodiment of the present invention.

Next, the fusing device D shown in FIG. 9 will be described.

The fusing device D is comprised of a pair of fusing rollers 10, 20 arranged parallel to each other, a prefusing guide 30, and a flat heat-generating body 40 above the prefusing guide.

The fusing roller 10 is supported by a bearing at a fixed position and is driven to rotate in the CCW direction in the figure by a drive means (not shown in the figure). Further, the roller 10 may have an internal heater 101 in it.

The fusing roller 20 functions as a pressure roller and is referred to hereinafter as a "pressure roller" or simply as a "roller". The pressure roller 20 is rotatably supported by a pair of pressure roller bearings. Each bearing is supported by a bearing support member so the roller 20 can move towards and away from the fusing roller 10. Further, a spring applies a fixed force urging the bearings in a direction toward the fusing roller 10. By means of the force from the spring, the pressure roller 20 is brought into contact with the fusing roller 10 to form a nip portion N.

The prefusing guide 30 is a plate-shaped guide used as a recording material guide member. The prefusing guide 30 is adjacent to the nip portion N at a side upstream of the nip portion N in the feed direction of the recording material. A paper delivery guide 50 may be provided on the downstream side of the nip portion N. A flat heating body 40 is used as a preheating member. The flat heat-generating body 40 is arranged to allow the toner image T on the recording material S guided on the prefusing guide 30 to be heated along the width of the recording material in a fixed area.

Furthermore, a thermistor TH may be arranged on the surface of the fusing roller 10. The thermistor TH is connected to a temperature controller. The temperature controller controls the heater 101 disposed inside the fusing roller 10 based on signals from the thermistor indicating the surface temperature of the fusing roller 10. Therefore, the temperature of the fusing roller 10 is maintained at a fixed temperature.

The heating body 40 is arranged essentially parallel to the prefusing guide 30. A line extending from the upstream edge 41 of the heating body 40 to the contact position N between the rollers 10, 20 forms an angle θ2 with the surface of the prefusing guide 30. A line extending from the downstream edge 42 of the heating body 40 to the contact position N between the rollers 10, 20 forms an angle θ1 with the surface of the prefusing guide 30.

According to the present invention, the relationship between the force F between the rollers 10, 20 at the contact position N and angles θ1 and θ2 is determined as follows:

$$0<F<0.5\theta_x^2+0.05\theta_x;$$

wherein $\theta_x$ is the smaller of θ1 and θ2. In the case of embodiment D, wherein the heating body 40 is parallel to the prefusing guide 30, θ2 will be smaller than θ1. Accordingly, in the case wherein the heating body 40 is parallel to the prefusing guide 30, the relationship between the force F between the rollers 10, 20 at the contact position N and the orientation of the heating body 40 is determined as follows:

$$0<F<0.5(\theta 2)^2+0.05(\theta 2).$$

The fusing roller 10 is preferably formed from aluminum pipe having a thickness of 0.9 mm and an external diameter of 20 mm. The roller 10 is preferably evenly coated on the outer peripheral surface of the pipe with a silicon rubber layer having heat resistant properties and is elastically deformable. The internal heater 101 provided inside the fusing roller 10 is preferably a 200 W halogen heater. The surface temperature of the roller 10 is normally set to 145° C.

The flat heater 40 is formed by a 400 W ceramic heater with a length of 40 mm and a thickness of 2.5 mm. The surface temperature of the heating surface is normally set to 165° C.

The pressure roller 20 has an external diameter of 20 mm and is evenly coated on the outer peripheral surface of an aluminum metallic core with a silicon rubber layer in like manner to the roller 10.

The prefusing guide 30 is a flat metallic plate which has a flat recording material guide surface.

According to the fusing device D described above, the fusing roller 10 is driven to rotate. The pressure roller 20 is driven to rotate by the rotation of the fusing roller 10.

The recording material S (recording paper) which maintains the toner image T is fed to a feeding device (not shown in the figure) and is then guided on the prefusing guide 30 and sent to the nip portion N. At this time, the toner image T is heated (radiant heat) by the heating body 40 opposite to this image to a degree where it is appropriately softened. The recording material S is then inserted into the nip portion N. In the nip portion N, the toner image T is heated and pressurized and then fused onto the recording paper S. The recording material S after toner image fusing is guided by the paper delivery guide 50 and then delivered.

In the fusing device D, when the recording paper S passes through the nip portion N of the pair of rollers 10, 20, the trailing edge of the recording paper S jumps away from the prefusing guide 30 due mainly to the difference in the peripheral speed of both rollers. However, the degree the recording material jumps is dependent on the combined force F (kg) of the nip portion N. Conversely, the angle θ2 formed by the edge 41 and the nip portion N and the straight line connecting the nip portion N with the surface of the prefusing guide 30 is regulated to satisfy the relationship of $0<F<0.5(\theta 2)^2+0.05(\theta 2)$. Therefore, the state in which the toner image T rubs and makes contact with the heat-generating body 40 due to the jumping of the trailing edge of the recording paper S resulting in the occurrence of image noise is sufficiently suppressed thus making it possible to ensure stable paper passing properties. In addition, the preheating by means of the heating body 40 can be used to its maximum limits to achieve stable fusing characteristics at comparatively low fusing temperatures. These reasons allow the toner image to be favorably fused.

Figure 10:
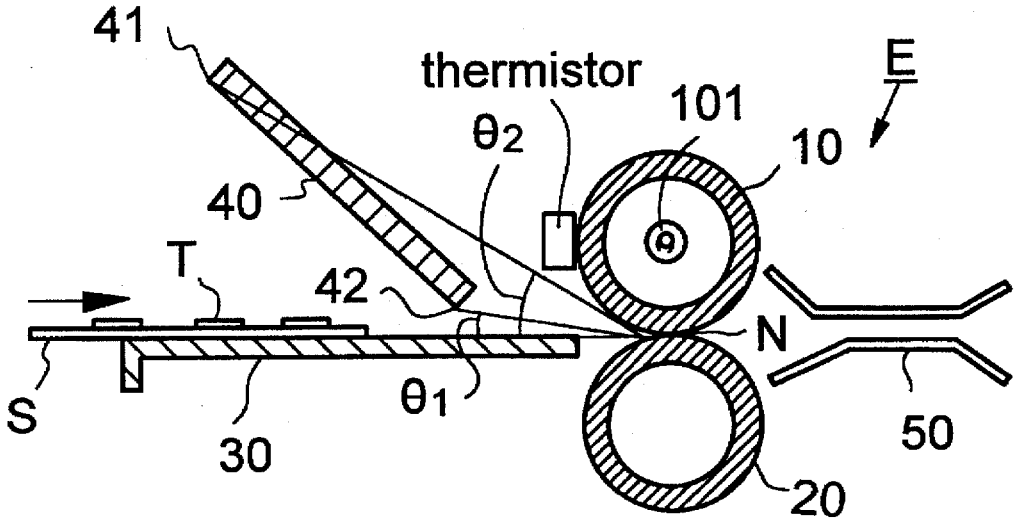
FIG. 10 is a side-view showing a fusing device of another embodiment of the present invention.

Next, the fusing device E shown in FIG. 10 will be described.

The fusing device E is comprised of a pair of fusing rollers 10, 20 arranged parallel to each other, a prefusing guide 30, and a flat heat-generating body 40 above the prefusing guide.

The fusing roller 10 is supported by a bearing at a fixed position and is driven to rotate in the CCW direction in the figure by a drive means (not shown in the figure). Further, the roller 10 may have an internal heater 101 in it.

The fusing roller 20 functions as a pressure roller and is referred to hereinafter as a "pressure roller" or simply as a "roller". The pressure roller 20 is rotatably supported by a pair of pressure roller bearings. Each bearing is supported by a bearing support member so the roller 20 can move towards and away from the fusing roller 10. Further, a spring applies a fixed force urging the bearings in a direction toward the fusing roller 10. By means of the force from the spring, the pressure roller 20 is brought into contact with the fusing roller 10 to form a nip portion N.

The prefusing guide 30 is a plate-shaped guide used as a recording material guide member. The prefusing guide 30 is adjacent to the nip portion N at a side upstream of the nip portion N in the feed direction of the recording material. A paper delivery guide 50 may be provided on the downstream side of the nip portion N. A flat heating body 40 is used as a preheating member. The flat heat-generating body 40 is arranged to allow the toner image T on the recording material S guided on the prefusing guide 30 to be heated along the width of the recording material in a fixed area.

Furthermore, a thermistor TH may be arranged on the surface of the fusing roller 10. The thermistor TH is connected to a temperature controller. The temperature controller controls the heater 101 disposed inside the fusing roller 10 based on signals from the thermistor indicating the surface temperature of the fusing roller 10. Therefore, the temperature of the fusing roller 10 is maintained at a fixed temperature.

The heating body 40 is arranged essentially parallel to the prefusing guide 30. A line extending from the upstream edge 41 of the heating body 40 to the contact position N between the rollers 10, 20 forms an angle θ2 with the surface of the prefusing guide. A line extending from the downstream edge 42 of the heating body 40 to the contact position N between the rollers 10, 20 forms an angle θ1 with the surface of the prefusing guide 30.

According to the present invention, the relationship between the force F between the rollers 10, 20 at the contact position N and angles θ1 and θ2 is determined as follows:

$$0<F<0.5\theta_x^2+0.05\theta_x;$$

wherein $\theta_x$ is the smaller of θ1 and θ2. In the case of embodiment E, wherein the heating body 40 is arranged at a significant angle with respect to the prefusing guide 30, θ1 will be smaller than θ2. Accordingly, in the case wherein the heating body 40 is arranged at a significant angle with respect to the prefusing guide 30, the relationship between the force F between the rollers 10, 20 at the contact position N and the orientation of the heating body 40 is determined as follows:

$$0<F<0.5(\theta 1)^2+0.05(\theta 1).$$

The fusing roller 10 is preferably formed from aluminum pipe having a thickness of 0.9 mm and an external diameter of 20 mm. The roller 10 is preferably evenly coated on the outer peripheral surface of the pipe with a silicon rubber layer having heat resistant properties and is elastically deformable. The internal heater 101 provided inside the fusing roller 10 is preferably a 200 W halogen heater. The surface temperature of the roller 10 is normally set to 145° C.

The flat heater 40 is formed by a 400 W ceramic heater with a length of 40 mm and a thickness of 2.5 mm. The surface temperature of the heating surface is normally set to 165° C.

The pressure roller 20 has an external diameter of 20 mm and is evenly coated on the outer peripheral surface of an aluminum metallic core with a silicon rubber layer in like manner to the roller 10.

The prefusing guide 30 is a flat metallic plate which has a flat recording material guide surface.

According to the fusing device E described above, the fusing roller 10 is driven to rotate. The pressure roller 20 is driven to rotate by the rotation of the fusing roller 10.

The recording material S (recording paper) which maintains the toner image T is fed to a feeding device (not shown in the figure) and is then guided on the prefusing guide 30 and sent to the nip portion N. At this time, the toner image T is heated (radiant heat) by the heating body 40 opposite to this image to a degree where it is appropriately softened. The recording material S is then inserted into the nip portion N. In the nip portion N, the toner image T is heated and pressurized and then fused onto the recording paper S. The recording material S after toner image fusing is guided by the paper delivery guide 50 and then delivered.

In the fusing device E, when the recording paper S passes through the nip portion N of the pair of rollers 10, 20, the trailing edge of the recording paper S jumps away from the prefusing guide 30 due mainly to the difference in the peripheral speed of both rollers. However, the degree the recording material jumps is dependent on the combined force F (kg) of the nip portion N. Conversely, the angle θ2 formed by the edge 41 and the nip portion N and the straight line connecting the nip portion N with the surface of the prefusing guide 30 is regulated to satisfy the relationship of $0<F<0.5(\theta 1)^2+0.05(\theta 1)$. Therefore, the state in which the toner image T rubs and makes contact with the heat-generating body 40 due to the jumping of the trailing edge of the recording paper S resulting in the occurrence of image noise is sufficiently suppressed thus making it possible to ensure stable paper passing properties. In addition, the preheating by means of the heating body 40 can be used to its maximum limits to achieve stable fusing characteristics at comparatively low fusing temperatures. These reasons allow the toner image to be favorably fused.

The present invention is particularly suited for suppressing the occurrence of image noise and the occurrence of wrinkles in the recording material due to contact between the toner image on the recording material and the preheating member for a wide range of recording materials, such as recording material for overhead projectors (OHP), envelope-shaped paper in which two sheets of paper are folded, thick paper or normal paper, in addition to sufficiently obtaining the preheating effect of the toner image by means of the preheating member.

Because the preheating effect can be used to its maximum limits, the preheating distance can be shortened and the size of the fusing device reduced.

Moreover, because the force of the nip portion can be set to lower values, the cost of the fusing device can be reduced.

Even further, because the fusing temperature can be set to lower values, the warm-up time of the fusing device is quickened and energy consumption reduced.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A fusing device for fusing a toner image onto a sheet, comprising:

a pair of members which are in contact with each other at a contact position with a force F (kg) along a predetermined sheet path;

a heating device located at an upstream side of said pair of members with respect to a direction of transportation of the sheet, said heating device facing a surface of the sheet on which the toner image is held, wherein a first line from said heating device to said contact position and a second line defined by said path makes an angle θ;

wherein the force F and the angle θ are set so as to satisfy the following formula:

$$0<F<0.5\theta^2+0.05\theta.$$

2. The fusing device as claimed in claim 1, wherein each of said members is a roller.

3. The fusing device as claimed in claim 2, wherein one of said members includes a heater.

4. The fusing device as claimed in claim 2, wherein:

said heating device comprises a third roller which has a heater in it;

an endless belt is wound around said third roller and one of said pair of members; and said first line extends from an outer peripheral surface of said third roller and said contact position.

5. The fusing device as claimed in claim 2, wherein said heating device comprises:

a third roller which has a heater;

an endless belt which is wound around said third roller and one of said pair of members.

6. The fusing device as claimed in claim 5, further comprising:

a member which is in contact with said endless belt to provide a release agent oil onto said endless belt.

7. The fusing device as claimed in claim 1, further comprising a spring which is connected with one of said members to press the one member toward another of said members.

8. The fusing device as claimed in claim 1, wherein said heating device has a surface which is facing the predetermined sheet path, said surface being set so as to be parallel to said first line.

9. The fusing device as claimed in claim 1, wherein at least one of the members is coated with an elastic material.

10. A fusing device for fusing toner images onto a sheet, comprising:

pressing means for pressing the sheet at a pressing position with a force F (kg) along a predetermined sheet path;

heating means located at an upstream side of said pressing means with respect to a direction of sheet transportation for heating the sheet;

wherein the force F and the heating means are set so as to satisfy the following formula:

$$0<F<0.5\theta^2+0.05\theta,$$

wherein θ is defined as an angle between a first line from said heating means to said pressing position and a second line defined by said predetermined path.

11. The fusing device as claimed in claim 10, wherein said pressing means includes a pair of rollers.

12. The fusing device as claimed in claim 11, wherein one of said rollers includes a heater.

13. The fusing device as claimed in claim 11, wherein said heating means comprises:

a heat roller which includes a heater; and an endless belt which is wound around said heat roller and one of said pair of rollers.

14. The fusing device as claimed in claim 11, wherein at least one of said pair of rollers is coated with an elastic material.

15. The fusing device as claimed in claim 10, further comprising:

a guide member which is located at an upstream side of said pressing means with respect to the direction of sheet transportation, said guide member defining the predetermined path.

16. A method for fusing a toner image onto a sheet, comprising the steps of:

pressing a pair of rollers against each other at a contact position with a force F (kg);

transporting the sheet to the contact position between said rollers along a predetermined path;

heating the sheet at a heating position upstream of the rollers with respect to a transporting direction of the sheet with a heater that is facing a surface of the sheet on which the toner image is held; and setting the force F and the heating position so as to satisfy the following formula:

$$0<F<0.5\theta^2+0.05\theta,$$

wherein θ is an angle defined by a first line from said heating position to said contact position and a second line defined by said predetermined path.

17. The method as claimed in claim 16, further comprising the step of providing a second heater in one of the pair of rollers.

18. The method as claimed in claim 17, further comprising the step of controlling a temperature of the roller in which said second heater is provided by controlling the second heater.

19. The method as claimed in claim 16, further comprising the step of rotating the pair of rollers.

20. The method as claimed in claim 16, further comprising the step of guiding the sheet along the predetermined path with a guide during the transporting step.

21. The method as claimed in claim 16, wherein in the pressing step one of said rollers is coated with an elastic material.

22. A heating device, comprising:

a pair of rollers which are in contact with each other at a contact position;

a guide member which is located at an upstream side of said contact position with respect to a transportation direction, said guide member having a surface along which a sheet holding a toner image is transported to said contact position;

a heating device which is facing said guide member, said heating device having a surface that is inclined with respect to the surface of said guide member.

23. The heating device of claim 22, wherein a distance between the surface of the guide member and an edge of an upstream side of the heating device with respect to the transportation direction is greater than a distance between the surface of the guide member and an edge of a downstream side of the heating device.

24. A fusing device for fusing a toner image onto a sheet, comprising:

a pair of members which are in contact with each other at a contact position with a force F (kg) along a predetermined sheet path;

a flat heating device located at an upstream side of said pair of members with respect to a direction of transportation of the sheet, said heating device facing the predetermined sheet path;

a line from an upstream edge of said heating device with respect to the direction of transportation to said contact position and a second line defined by said sheet path makes an angle θ2;

a line from a downstream edge of said heating device with respect to the direction of transportation to said contact position and the second line defined by said sheet path makes an angle θ1;

wherein the force F and an orientation of the heating device are set so as to satisfy the following formula:

$$0<F<0.5(\theta_x)^2+0.05(\theta_x);$$

wherein $(\theta_x)$ is a smaller of θ1 and θ2.

25. The fusing device as claimed in claim 24, wherein each of said members is a roller.

* * * * *